US006531255B2

(12) United States Patent
Kim et al.

(10) Patent No.: US 6,531,255 B2
(45) **Date of Patent: *Mar. 11, 2003**

(54) MICRO-SERRATED PARTICLES FOR USE IN COLOR TONER AND METHOD OF MAKING SAME

(75) Inventors: Chul-Hwan Kim, Daejon (KR); Seung-Wook Lim, Daejon (KR); Tae-Ho Park, Daejon (KR); Hyun-Nam Yoon, Towaco, NJ (US)

(73) Assignee: DPI Solutions, Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/860,960

(22) Filed: May 18, 2001

(65) Prior Publication Data

US 2002/0172881 A1 Nov. 21, 2002

(51) Int. Cl.[7] ..... G03G 9/08

(52) U.S. Cl. ..... 430/109.4; 430/110.3; 430/110.4; 430/137.1; 524/223; 428/402

(58) Field of Search ..... 430/110.3, 110.4, 430/109.3, 109.4; 428/402; 524/233

(56) References Cited

U.S. PATENT DOCUMENTS

| | | | | |
|---|---|---|---|---|
| 2,297,691 A | | 10/1942 | Carlson | 95/5 |
| 3,590,000 A | | 6/1971 | Palerermiti et al. | 252/62.1 |
| 4,298,672 A | | 11/1981 | Lu | 430/108 |
| 4,338,390 A | | 7/1982 | Lu | 430/106 |
| 4,636,451 A | * | 1/1987 | Matkin et al. | 430/110.4 |
| 4,645,727 A | | 2/1987 | Ong et al. | 430/106 |
| 4,778,742 A | | 10/1988 | Ong et al. | 430/106 |
| 4,880,432 A | * | 11/1989 | Egan et al. | 8/647 |
| 5,102,761 A | | 4/1992 | Ohsaki et al. | 430/106 |
| 5,114,821 A | | 5/1992 | Haack | 430/110 |

(List continued on next page.)

FOREIGN PATENT DOCUMENTS

| | | | |
|---|---|---|---|
| GB | 1373531 | 11/1974 | C08G/20/02 |
| JP | 3-121466 | 5/1991 | G03G/9/087 |
| JP | 5-134458 | 5/1993 | G03G/9/087 |

OTHER PUBLICATIONS

Webster's II New Riverside Dictionary. Boston: Houghton–Mifflin Co. p. 1066. (1984).*

Diamond, Arthur S. (editor) Handbook of Imaging Materials. New York: Marcel–Dekker, Inc. (1991) p. 178.*

U.S. Ser. No. 09/826,543, filed Apr. 5, 2001, entitled "Method of Producing Toner for Developing Latent Electrostatic Images by Way of Dispersion Dyeing", of H–N Yoon.

U.S. Ser. No. 09/860,959, filed May 18, 2001 (now U.S. patent. 6,461,783, issued Oct. 8, 2002), entitled "Micro–Serrated Color Toner Particles and Method of Making Same", of Chul–Hwan Kim et al.

U.S. Ser. No. 09/860,953, filed May 18, 2001, entitled "Micro–Serrated, Dyed Color Toner Particles and Method of Making Same", of Chul–Hwan Kim et al.

Powder Technology Handbook, 2nd edition, Marcell Dekker Publications (1997), pp. 3–13, by K. Gotoh et al.

Physical Chemistry of Surfaces, 6th edition, by A.W. Adamson and A.P. Cast (1997), John Wiley and Sons, NY, NY.

Aldrich Handbook of Fine Chemicals and Laboratory Equipment 2000–2001, Milwaukee, p. 1372.

Polymer Science Dictionary, London: Elsevier Applied Science, pp. 361 and 385, by Mark S.M. Alger.

Chemical Abstract Registry Nos. 17418–58–5, 31810–89–6 and 6439–53–8.

* cited by examiner

*Primary Examiner*—Christopher Rodee
(74) *Attorney, Agent, or Firm*—Michael W. Ferrell

(57) ABSTRACT

A particulate composition suitable for making color toner includes resin particles optionally containing a charge control agent. The particles are characterized by a micro-serrated surface exhibiting a surface roughness index of at least about 1.2 and preferably higher. A process for making the particulate composition utilizes a vaporizable plasticizer.

16 Claims, 2 Drawing Sheets

U.S. PATENT DOCUMENTS 5,200,290 A 4/1993 Ong et al. ..... 430/115
5,212,033 A 5/1993 Tsubota et al. ..... 430/106
5,227,460 A 7/1993 Mahabadi et al. ..... 528/272
5,296,325 A 3/1994 Ohtsuka et al. ..... 430/106
5,352,521 A 10/1994 Hotta et al. ..... 428/402
5,376,494 A 12/1994 Mahabadi et al. ..... 430/137
5,437,953 A 8/1995 Russell et al. ..... 430/106
5,470,687 A 11/1995 Mayama et al. ..... 430/137
5,500,321 A 3/1996 Kasuya et al. ..... 430/109
5,547,796 A * 8/1996 Kohtaki et al. ..... 430/110.4
5,565,298 A 10/1996 Suguro et al. ..... 430/137
5,693,444 A 12/1997 Takagi et al. ..... 430/106.6
5,708,079 A * 1/1998 Eichenauer et al. ..... 525/71
5,866,662 A 2/1999 Hatke et al. ..... 526/160
6,001,524 A 12/1999 Yoon et al. ..... 430/106
6,156,473 A 12/2000 Tyagi et al. ..... 430/137
6,287,742 B1 9/2001 Yoon ..... 430/137.19
6,387,583 B1 5/2002 Yoon ..... 430/137.16

MICRO-SERRATED PARTICLES FOR USE IN COLOR TONER AND METHOD OF MAKING SAME

CROSS-REFERENCE TO RELATED APPLICATIONS

The present invention is related to that disclosed in a pending patent applications, U.S. patent application Ser. No. 09/571,772 filed on May 16, 2000, now U.S. patent application No. 6.287,741 and U.S. patent application Ser. No. 09/860,959 filed May 18, 2001 entitled MICRO-SERRATED COLOR TONER PARTICLES AND METHOD OF MAKING SAME, the disclosures of which are incorporated herein by reference.

TECHNICAL FIELD

This invention generally relates to particulate resin compositions suitable for production of high-resolution toners for developing latent electrostatic images in electrophotography, electrostatic recording and electrostatic printing. More specifically, this invention relates in preferred embodiments to a dispersion comminution method of forming suitably sized resin particles which may be converted to a particulate toner composition for high-resolution electrophotography, electrostatic recording and electrostatic printing by incorporating a coloring agent and other suitable components therein.

BACKGROUND OF THE INVENTION

The formation and development of images on the surface of photoconductive materials by electrostatic means is well known. The basic electrophotographic imaging process (U.S. Pat. No. 2,297,691) involves placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic toner material. The toner will normally be attracted to those areas of the photoreceptor which retain a charge, thereby forming a toner image corresponding to the electrostatic latent image. This developed image may then be transferred to a substrate such as paper. The transferred image subsequently may be permanently affixed to the substrate by heat, pressure, a combination of heat and pressure, or other suitable fixing means such as solvent or over coating treatment.

Also well known are techniques to develop such electrostatic images. Developer is a vehicle in which are dispersed charged colored toner particles. The photoreceptor bearing the electrostatic latent image is contacted with the developer. The contact causes the charged toner particles in the developer to migrate to the charged areas of the photoreceptor to develop the latent image. Then, the photoreceptor is developed with the charged colored particles adhering to the latent image in image configuration. The developed image is then typically transferred to a suitable substrate, such as paper or transparency material, and optionally may be fixed to the substrate by heat, pressure or other suitable means.

Toners and developer compositions including colored particles are well known. In this regard, see U.S. Pat. Nos.: 5,352,521; 4,778,742; 5,470,687; 5,500,321; 5,102,761; 4,645,727; 5,437,953; 5,296,325 and 5,200,290 the disclosures of which are hereby incorporated by reference. The traditional compositions normally contain toner particles consisting of resin and colorants, wax or a polyolefin, charge control agents, flow agents and other additives. A typical toner formulation generally contains about 90–95 weight percent resin, about 2–10 weight percent colorant, from about 0 to about 6 weight percent wax, from about 0 to about 3 weight percent charge control agent, about 0.25–1 weight percent flow agent and from about 0 to about 1 weight percent other additives. Major resins are styrene-acrylic copolymers, styrene-butadiene copolymers and polyesters. The colorants usually are selected from cyan dyes or pigments, magenta dyes or pigments, yellow dyes or pigments, and mixtures thereof.

Conventional color toner particles are produced by a milling process described, for example, in the aforementioned U.S. Pat. No. 5,102,761. In that process, a polyacrylate resin is compounded with pigments, charge control agents ("CCA") and occasionally wax in a melt mixer. The resulting polymer mixture is mechanically crushed and then milled into small particles. The conventional toner particles typically have an irregular shape and a broad distribution in particle size. For optimum resolution of images and color, smaller particles perform better. Thus, for example, it is difficult to obtain resolutions better than about 600 dots/inch when the average particle size is more than about 7 $\mu$m. For resolutions in the order of about 1200 dots/inch, particle sizes smaller than 5 $\mu$m are typically needed. It is difficult to make particles smaller than about 7–10 $\mu$m by conventional processes because of the high energy cost of producing small particles as well as uniform narrow particle size distribution.

Many previous attempts to produce small toner particles with the size smaller than 7 $\mu$m have been made. For example, the aforementioned U.S. Pat. Nos. 5,352,521, 5,470,687 and 5,500,321 disclose toner particles produced by dispersion polymerization. In such a method, monomers (typically styrenic and acrylate monomers) and additives such as pigments, CCA and wax are mixed together to form a dispersion. This is then further dispersed into an aqueous or a non-aqueous medium and the monomers are polymerized to form toner particles. This method has the advantage over other methods that spherical toner particles with a small diameter can be prepared by a single process. However, the polymerization involves a substantial volume contraction and it results in entrapment of the dispersion medium inside the toner particles. Furthermore, the polymerization is difficult to be brought to completion and a substantial portion of the monomers remains in the toner particles. The residual monomers and the entrapped dispersion solvent are difficult to separate from the particles. Also, the polarity of the polymerizing materials changes drastically in the course of the polymerization and the additives tend to exude from the particle bulk and tend to concentrate on the surface thereof. Further, agents employed, such as dispersion-stabilizing agent and surface active agent, which cause the charging characteristics and preservability of the toner particles to deteriorate, remain on the surface of the toner particles, and those agents are extremely difficult to remove from the toner particles. Some methods have included the suggestion of dispersing polymer/solvent droplets in a water medium and shearing the mixture. However, water tends to get into the interstices between particles and agglomerate them. Once agglomeration occurs, it is very difficult to drive off the water without damaging or otherwise altering the physical properties of the particles, especially with respect to polymers having relatively low softening points, that is below about 100° C.

A co-pending application, U.S. patent application Ser. No. 09/571,772 discloses a method of producing toner particles by comminuting resin particles comprising a colorant and a charge control agent in a solvent which does not dissolve the resin. However, applicability of the method is somewhat limited to toner resins with a relatively low molecular weight and the method generally requires a moderately high temperature and a vigorous shearing for effective comminution of toner particles. Furthermore, the toner particles produced by the method typically have a smooth surface texture and tend to lack fast triboelectric charging characteristics which is important in mono-component electrophotography development systems.

Co-pending U.S. patent application Ser. No. 09/860,959 entitled MICRO-SERRATED COLOR TONER PARTICLES AND METHOD OF MAKING SAME, discloses an improved method of producing toner particles by an improved dispersion comminution method of producing high-resolution color toner which has a superior combination of properties for electrophotographic imaging systems. The process includes forming spherical toner particles with a small diameter distribution by way of dispersing a polymer resin compounded with a colorant, a vaporizable plasticizer component and other additives in a dispersion medium including a surfactant under shearing conditions. The method may be carried out at a substantially low temperature compared to the method disclosed aforementioned U.S. patent application Ser. No. 09/571,772 and allows a resin with a high molecular weight to be used for preparing a toner composition. Furthermore, the toner particles produced by the method tend to have a narrow size distribution. Also, the toner particles can be made to have a rough surface texture and thus to have a fast charging characteristics.

The above-cited references generally describe methods of producing toner compositions by first blending all constituents comprising a toner composition and subsequently forming a particulate toner composition either by a milling, a polymerization or a comminution process. Another approach proposed for producing a toner composition is to prepare a particulate resin composition and hen subject the composition to a process of incorporating a colorant and other toner additives. Such an approach to produce a toiler is disclosed in U.S. Pat. No. 6,001,524, which is incorporated by reference. The '524 patent discloses polyester toner particles which are produced by incorporating a dye and a charge control agent into polyester resin particles. The resin particles are produced by a non-aqueous dispersion polymerization of suitable monomers. This method has the advantage of that spherical toner particles with a small diameter can be prepared. However, the polymerization involves a substantial volume contraction and it results in entrapment of the dispersion medium inside the toner particles. The entrapped dispersion solvent is difficult to separate from the particles and tend to produce a foggy image when printed with the toner. Furthermore, the toner particles tend to have a smooth surface texture. The smooth surface texture and the entrapped dispersion solvent tend to make the charge generation in these particles too slow for use in mono-component electrophotography systems.

Another desirable property in a particulate toner composition is a narrow particle size distribution. It is generally believed that a narrow size distribution leads to a more uniform charge distribution in the toner composition which. In turn, leads to a better line resolution in a printed image as well as reduction in spotty background. The conventional milling method of producing toner particles is generally inefficient in producing particles with a narrow size distribution and therefore has to employ a classification step to remove particles that are too small or too large from the toner composition.

Narrowness of the size distribution may be expressed by the 80% span (the span). The span is defined as the ratio of the size range in which middle 80% by volume of the particles occupy to the median size. A more detailed description of the definition of the span is in a later section on the characterization methods used in the present invention. A smaller value of the span therefore means a narrower size distribution. The span value of a typical toner composition which is commercially available by way of a conventional classification step is about 1.2. A method of toner particle formation yielding particles with the span value less than 1.2 without a classification process is highly desirable.

There is continuing interest in the development of new and improved methods of producing toners for application in high-resolution electrophotography.

Accordingly, an object of the present invention is to provide an improved dispersion comminution method of producing resin particles suitable for production of high-resolution color toner by forming spherical resin particles with a small diameter and a narrow size distribution by way of dispersing a polymer resin compounded with a vaporizable plasticizer component and an optional charge control agent in a dispersion medium including a surfactant under a shearing condition.

Another object of the present invention is to provide an improved dispersion comminution method of producing finely divided resin particles herein the comminution process may be carried out at a low temperature.

Yet another object of the present invention is to provide an improved dispersion comminution method of producing resin particles wherein a polymer resin with a relatively high molecular weight may be expeditiously comminuted.

Still another object of the present invention is to provide a method of producing resin particles comprising a polymer resin and optionally a charge control agent, which are substantially spherical in shape with a diameter in the range of about 1 to 10 $\mu$m as well as a narrow particle size distribution.

A further object of the present invention is to provide resin particles suitable for production of high-resolution color toner which are substantially spherical in shape and have a serrated surface texture exhibiting fast charging characteristics.

Still other objects and advantages of the present invention shall become apparent from the accompanying description, examples and Figures.

SUMMARY OF INVENTION

There is provided in accordance with the present invention a particulate toner composition including resin particles containing a resin component and optionally a charge control agent characterized in that the resin particles have a micro-serrated surface exhibiting a surface roughness index of greater than about 1.2. Roughness indices of greater than about 1.5 or 2 are believed readily achieved if so desired.

Typically, the resin component has a weight average molecular weight, Mw, of from about 3,000 to about 100,000.

In another aspect of the present invention there is provided a process for preparing a particulate resin composition for production of high-resolution color toner for developing latent electrostatic images including the steps: a) preparing a first resin composition containing a resin component, an optional charge control agent and a vaporizable plasticizer component which reduces the melt viscosity of the resin composition and thereby facilitates the overall comminution process of this invention; b) dispersing the resin composition in an organic medium comprising a surfactant, wherein the resin component is substantially insoluble in the organic medium; c) comminuting the resin composition to form particulate resin particles by application of shear at an elevated temperature; d) removing the vaporizable plasticizer component by evaporation by maintaining the dispersion of particulate resin composition in the medium at an elevated temperature; e) recovering the resin particles using a filtration process, followed by washing with an organic solvent with a low boiling temperature and subsequently drying the particles. Without intending to be bound by any theory, it is believed that the micro-serrated structure of the particles is imparted to them during removal of the vaporizable plasticizer.

In a preferred aspect, the particulate resin composition comprises a polymer resin, and an optional charge control agent. The resin particles are substantially spherical in shape and have a volume average diameter in the range of from about 1 to about 10 microns. Furthermore, the resin particles have a uniform and narrow size distribution with the span value less than 1.0, more preferably, with the span value less than 0.8. A particularly desirable and surprising aspect of the present invention is that the resin particles may be made to have an irregular micro-serrated surface texture that increases the surface area. Toner particles made from the resin particles will have substantially improved triboelectric charging characteristics such as charging speed. A fast triboelectric charging characteristic of a toner composition is particularly important when the toner composition is used in a mono-component development systems which are widely employed in desktop laser printers.

Any suitable polymer resin may be employed as the resin component of the present invention. Particularly preferred resins include polyester resins and styrene copolymer resins. The polymer resin is typically an amorphous resin with a glass transition temperature in the range of from about 40° C. to about 90° C. The use of a vaporizable plasticizer component in the present method of producing resin particles significantly increases the molecular weight range of polymer resin usable for toner application. A desirable molecular weight range of a polymer resin processable with the method of the present invention is a weight average molecular weight in the range of from about 3000 g/mol to about 100,000 g/mol. The resin may preferably contain functional moieties which improves the compatibility with functionalized dyes as a part of its polymer chain chemical structure.

The resin may have functional sites in its polymer chain structure suitable for interacting with a functionalized dye selected from the group consisting of: hydroxyl moieties; alkoxyl moieties; sulfonic or derivatized sulfonic moieties; sulfonic or derivatized sulfonic moieties; carboxyl or derivatized carboxyl moieties; phosphonic or derivatized phosphonic moieties; phosphinic or derivatized phosphinic moieties; thiol moieties, amine moieties; alkyl amine moieties; quatemized amine moieties; and mixtures thereof.

The first resin composition is typically prepared by melt compounding the resin component with an optional charge control agent and the vaporizable plasticizer component. The charge control agent may be dispersed in the resin and may be a positive charge control agent or a negative charge control agent.

Presence of the vaporizable plasticizer component significantly reduces the melt viscosity and the flow temperature of the first resin composition and therefore allows the whole particle preparation process to be carried out at a substantially lower temperature than the process without a vaporizable plasticizer component. The vaporizable plasticizer component is selected from organic solvents which are absorbable in the polymer resin component and have a boiling temperature less than 200° C. It is preferable that the vaporizable plasticizer component is insoluble in the organic solvent component employed in the dispersion preparation and comminution steps of the present invention. Preferred examples of the vaporizable plasticizer components are acetone, tetrahydrofuran, 1,2-dichloroethane, 1-methyl-2-pyrrolididone, dimethylformamide, cyclohexanone, dimethylsulfoxide, chirobenzene. The first resin composition may be prepared by melt compounding at a temperature which is determined by the choice and the amount of vaporizable plasticizer component in the first resin composition. It is preferable to carry out the preparation of the first resin composition at as low a temperature as feasible, however.

The first resin composition is dispersed in the immiscible organic medium by subjecting the mixture of the molten resin composition and the organic medium to a mild shear at an elevated temperature. Any suitable mixing equipment may be employed for this step. An example of such equipment is a vessel equipped with an impeller-type agitator and a means of heating the content of the vessel. Effective formation of dispersion as well as successful comminution requires that the solubility parameter of the organic medium be generally different from the solubility parameter of the resin component by at least about 1. In preferred embodiments the solubility parameter of the organic medium is larger or smaller than the solubility parameter of the resin component by at least about 2. Any suitable organic medium which does not dissolve the resin component may be employed. Particularly preferred solvents include paraffin solvents, water and poly (ethylene glycol).

The organic medium includes a surfactant which may be a non-ionic, a cationic or an anionic surfactant. Preferred examples of such surfactants include copolymers of vinylpyrrolidonone, alkylated maleic acid copolymers, polymers containing ethylene oxide moieties, polymers containing propylene oxide moieties and sodium dodecylsulfate. The surfactant is generally present in the organic medium in an amount from about 0.2 to about 15 weight percent based on the amount of solvent present whereas from about 1 to about 10 weight percent based on the amount of solvent present is typical.

The first resin composition is generally from about 10 to about 70 weight percent of the combined weight of the resin composition in the organic medium during the step of dispersing the first resin composition. From about 20 to about 50 weight percent of the combined weight of the first resin composition in the organic medium is more typical. The first resin composition may be introduced to the organic medium maintained at an elevated temperature under a shearing condition. Equally preferably, the organic medium may be introduced to molten first resin composition maintained at an elevated temperature under a shearing condition. During the step of dispersing the first resin composition, the organic medium is maintained at an elevated temperature. The temperature may be selected to be any value so long as it is high enough to ensure fluid-like behavior of the first resin composition and low enough not to have a substantial evaporation of the vaporizable plasticizer component in the first resin composition. Therefore the temperature may be selected to be any value by varying the type and the amount of the vaporizable plasticizer component in the first resin composition. While any suitable elevated temperature may be employed, preferred temperatures are in the range at least about 30° C. to about 200° C.

The step of comminuting the first resin composition is typically carried out by further subjecting the dispersion of the first resin composition in the organic medium at an elevated temperature. The comminuting temperature may be selected to be any value so long as it is high enough to ensure fluid-like behavior of the first resin composition and low enough not to have a substantial evaporation of the vaporizable plasticizer component. Therefore the temperature may be selected to be any value by varying the type and the amount of the vaporizable plasticizer component in the first resin composition. While any suitable elevated temperature may be employed, preferred temperatures are in the range at least about 30° C. to about 200° C. However, it needs not be the same temperature as the dispersion temperature. The shearing required for the comminuting step of the present invention is substantially smaller due to the presence of the vaporizable plasticizer component compared to that for the process without a vaporizable plasticizer component. Effective comminution may be obtained in a vessel containing a 10 cm radius impeller-type agitator and with the agitator rotation speed as low as 100 rpm.

The step of removing the vaporizable plasticizer component from the comminuted resin composition is typically carried out by maintaining the mixture of the resin component and the organic medium at an elevated temperature close to or above the boiling temperature of the vaporizable plasticizer component. Under such conditions, the vaporizable plasticizer component evaporates from the comminuted particulate resin composition and subsequently from the processing vessel. The process may be more expeditiously carried out when the vaporizable plasticizer composition is immiscible with the organic medium. The removal step is stopped when the vaporous effluent from the process vessel does not show a trace of the vaporizable plasticizer component.

The steps of dispersion, comminution and removal of the vaporizable plasticizer component may be conducted in distinctive and discontinuous steps, sequentially in a single vessel or in a series of overlapping steps in a single vessel.

The step of recovering the comminuted resin particles is carried out by first cooling the content of the process vessel below the glass transition temperature of the resin component and subsequently by filtering solid resin particles from the organic medium. Any suitable filtration equipment may be used. Subsequently, dry resin particles are obtained by washing the filtered particles with a low boiling organic solvent such as isohexane and drying off the wash solvent at a temperature below the glass transition temperature of the resin component.

In another aspect of the present invention, there is provided a particulate resin composition comprising resin particles that are substantially spherical in shape, have an average diameter of from about 1 to about 10 microns, and have a uniform and narrow size distribution with the span value less than 1.0, more preferably, with the span value less than 0.8, prepared by comminuting a precursor composition comprising a vaporizable plasticizer component in an organic medium under shear at an elevated temperature wherein the particles are substantially insoluble in the organic medium. The resin component may be a polyester resin or a styrene copolymer resin.

In yet another aspect of the present invention, there is provided a particulate resin composition comprising resin particles that are substantially spherical in shape, have an average diameter of from about 1 to about 10 microns, have a uniform and narrow size distribution with a span value less than 1.0, more preferably, with s span value less than 0.8 and further have an irregular surface texture characterized by the surface roughness index greater than 1.2. The surface roughness index is defined as the ratio of surface areas of the irregular textured particles and smooth texture particles and is discussed in more detail hereinafter.

In still yet another aspect of the present invention, there is provided a particulate resin composition comprising a polyester resin component and an optional charge control agent wherein the particles are substantially spherical in shape, have a volume average diameter in the range of from about 1 to about 10 microns, have a uniform and narrow size distribution with the span value less than 1.0, more preferably, with the span value less than 0.8. The particles have an irregular surface texture characterized by the surface roughness index greater than 1.2 wherein the polyester resin component includes a polyester resin having a weight average molecular weight of about 100,000 g/mol or less.

In a still further aspect of the present invention, there is provided a articulate resin composition comprising a styrene copolymer resin component and an optional charge control agent wherein the particles are substantially spherical in shape, have a volume average diameter in the range of from about 1 to about 10 microns, have a uniform and narrow size distribution with the span value less than 1.0, more preferably, with the span value less than 0.8. The particles have an irregular surface texture characterized by the surface roughness index greater than 1.2 wherein the styrene copolymer resin component includes a styrene copolymer having a weight average molecular weight of about 100,000 g/mol or less. Particularly preferred styrene copolymer resins include copolymers of styrene and acrylate as well as copolymers of styrene and butadiene.

BRIEF DESCRIPTION OF DRAWINGS

The invention is described in detail below with reference to the various Figures wherein.

DETAILED DESCRIPTION OF THE PREFERRED EMBODIMENTS

Figure 1:
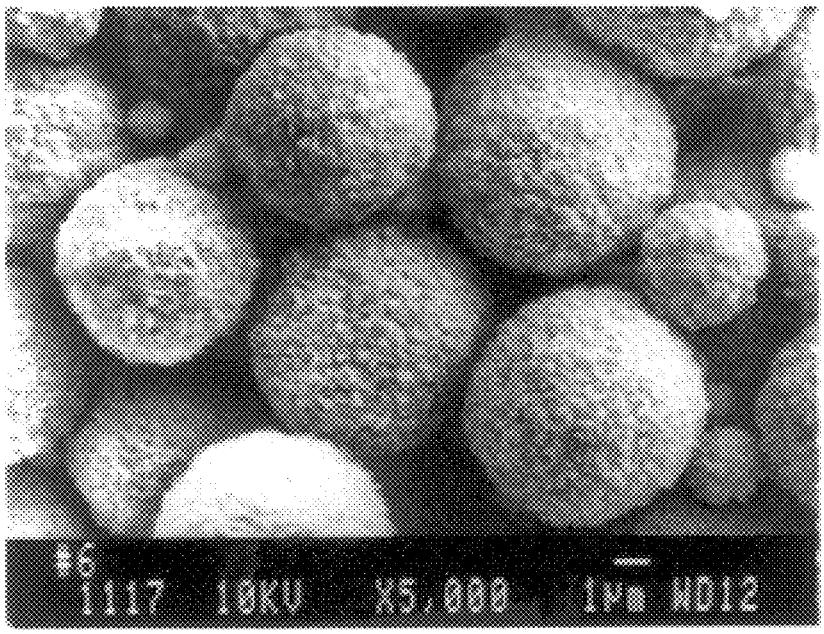
FIG. 1 is a scanning electron micrograph of a toner composition including particles which have a micro-serrated surface texture, generally of the class of the present invention.

The first resin composition is typically prepared by melt compounding a resin component with an optional charge control agent and a vaporizable plasticizer component.

Illustrative examples of suitable resins selected for the particulate compositions of the present invention include thermoplastics such as polyamides. polyolefins, styrene aciylate, styrene methacrylates, styrene butadienes, and epoxies, polyurethanes vinyl resins, including homopolymers or copolymers of two or more vinyl monomers, and polyesters generally, such as the polymeric esterification products of a dicarboxylic acid and a diol comprising a diphenol. Of the above resin. polyester copolymers, and styrenic copolymers are more preferable for use in the present invention.

The polymer resin may have functional sites in its chain structure to improve the compatibility with a colorant selected from the group consisting of: hydroxyl moieties; alkoxyl moieties; sulfonic or derivatized sulfonic moieties; sulfonic or derivatized sulfonic moieties; carboxyl or derivatized carboxyl moieties; phosphonic or derivatized phosphonic moieties; phosphinic or derivatized phosphinic moieties; thiol moieties, amine moieties; alkyl amine moieties; quaternized amine moieties; and mixtures thereof.

The weight-average molecular weight ($M_w$) of the resin as measured by gel permeation chromatography (GPC) is in the range typically from about 3,000 g/mol to about 100,000 g/mol, and preferably from about 5,000 g/mol to about 20,000 g/mol. The molecular weight distribution ($M_w/M_n$) of the linear polymer is in the range typically from about 1.5 to about 6, and preferably from about 2 to about 4. The onset glass transition temperature ($T_g$) of the linear polymer as measured by differential scanning calorimetry (DSC) is in the range typically from about 50° C. to about 90° C. and preferably from about 50° C. to about 70° C.

Various known suitable effective positive or negative charge controlling additives (CCA) can be selected for incorporation into the particulate resin compositions of the present invention, preferably in an amount of 0 to about 10, more preferably about 0 to about 3, percent by weight. Examples include quaternary ammonium compounds inclusive of alkyl pyridinium halides, alkyl pyridinium compounds, reference U.S. Pat. No. 4,298.672, the disclosure of which is totally incorporated herein by reference; organic sulfate and sulfonate compositions, U.S. Pat. No. 4,338.390, the disclosure of which is totally incorporated herein by reference; bisulfonates; ammonium sulfates (DDAES); distearyl dimethyl ammonium bisulfate (DDAMS), reference U.S. Pat. No. 5,114,821, the disclosure of which is totally incorporated herein by reference; cetyl pyridinium tetrafluoroborates; distearyl dimethyl ammonium methyl sulfate, aluminum salts, such as BONTRON E84™ or E88™ (Oriental Chemicals); quaternary ammonium nitrobenzene sulfonates; mixtures of charge enhancing additives, such as DDAMS and DDAES; other known charge additives; and the like. Moreover, effective known internal and external additives may be selected for the toners of the present invention in embodiments thereof.

Incorporation of the vaporizable plasticizer component in the first resin composition significantly reduces the melt viscosity and flow temperature of the resin composition and therefore allows the whole toner preparation process to be carried out at a substantially lower temperature than the process without a vaporizable plasticizer component. The vaporizable plasticizer component is selected from organic solvents which are absorbable in the polymer resin component by more than 1 percent by weight and have a boiling temperature less than 200° C. It is preferable that the vaporizable plasticizer component is insoluble in the organic solvent used in the dispersion preparation and comminution steps of the present invention. Preferred examples of the vaporizable plasticizer components are: acetone, tetrahydofuran, 1,2-dichloroethane, 1-methyl-2-pyrrolididone, 3-pentanone, cyclohexanone, dimethylformamide, dimethylsulfoxide, and chlorobenzene. The amount of the vaporizable plasticizer component used in the present invention varies, however, a typical amount is in the range of from about 5 percent by weight to about 50 percent by weight of the resin component and preferably in the range of about 10 percent by weight to about 30 percent by weight of the resin component.

For the method of uniformly blending the resins, colorants and charge control agents, conventionally known methods such as melt blending in an agitator-equipped vessel, melt-kneading in a sealed kneader and melt-mixing in a double screw extruder.

The first resin composition is dispersed in the immiscible organic medium comprising an organic solvent component and a surfactant by subjecting a mixture of the molten resin composition and the organic medium to a mild shear at an elevated temperature. Any suitable mixing equipment may be employed for this step. A preferred such equipment is a vessel equipped with an impeller-type agitator and a means of heating the content of the vessel.

Effective dispersion as well as successful comminution in the following step may be accomplished with an organic solvent component that does not dissolve the resin component. More specifically, it is preferable that the solubility parameter value of the solvent component differs from that of the resin by 1.0 or more, more preferably 2.0 or more. For example, it is preferable to employ a non-polar solvent component having a low solubility parameter value such as paraffins. paraffinic esters, paraffinic amides and paraffinic ethers in combination with polyester resin. However, when a highly polar solvent such as water, methanol, propanol, and acetone is employed as a solvent component for the operation, significant coalescence of the resin results. On the other hand, when a non-polar resin such as a styrenic copolymer resin is dispersed, it is preferable to use a polar solvent component such as poly-(ethylene glycol) with the number average molecular weight leas than 1,000. If a non-polar solvent component such as a paraffin, a paraffinic ester, a paraffinic amide or a paraffinic ether is employed in the dispersion operation of the styrenic copolymer, substantial swelling and coalescence occurs.

A surfactant used in conjunction with the aforementioned organic solvent component in the dispersion operation performs two important functions for successful formation of small toner particles. First, it prevents coalescence of the molten resin droplets during the process. In the inventive process, the process is carried out generally at a temperature near to or higher than the glass transition temperature of resin. Thus, in the absence of the surfactant, the particles are in the molten state, tend to coalesce in an uncontrollable manner and thus fail to reduce the particle size to a level suitable for producing a high-resolution toner composition. Secondly, the relative amount of surfactant to the amount of resin particles in the bath determines the particle size. The surfactants, because of their chemical structures, tend to concentrate at the interface between the non-solvent and the molten particulate resins. Therefore, a larger amount of surfactant tends to produce smaller particles and a smaller amount tends to produce larger particles. The surfactant may be anionic, cationic or non-ionic.

Preferred examples of such surfactants include copolymers of vinylpyrrolidonone, alkylated maleic acid copolymers, polymers containing ethylene oxide moieties, polymers containing propylene oxide moieties and sodium dodecylsulfate. The surfactant is generally present in the organic medium in an amount from about 0.2 to about 15 weight percent based on the amount of solvent present whereas from about 1 to about 10 weight percent based on the amount of solvent present is typical.

The first resin composition is generally from about 10 to about 70 weight percent of the combined weight of the first resin composition in the organic medium (i.e., solvent/surfactant) during the step of dispersing the first resin composition. From about 20 to about 50 weight percent of the combined weight of the first resin composition in the organic medium is more typical.

The first resin composition may be introduced to the organic medium maintained at an elevated temperature under a mild shearing condition. Equally preferably, the organic medium may be introduced to molten first resin composition maintained at an elevated temperature under a mild shearing condition. Any suitable mixing equipment may be employed for this step. A preferred such equipment is a vessel equipped with an impeller-type agitator and a means of heating the content of the vessel. During the step of dispersing the first resin composition, the organic medium is maintained at an elevated temperature. The temperature may be selected to be any value so long as it is high enough to ensure fluid-like behavior of the first resin composition and low enough not to have a substantial evaporation of the vaporizable plasticizer component in the first resin composition. Therefore the temperature may be selected to be any value by varying the type and the amount of the vaporizable plasticizer component in the first resin composition. While any suitable elevated temperature may be employed, preferred temperatures are in the range at least about 30° C. to about 200° C. The dispersion operation continues until the mixture develops an opalescent appearance which indicates that the first resin component has separated into small droplets.

During the step of comminuting the droplets, the organic medium is maintained at an elevated temperature which is close to or higher than the glass transition temperature of the resin component. Any suitable mixing equipment may be employed for this step. A preferred such equipment is a vessel equipped with an impeller-type agitator and a means of heating the content of the vessel. While any suitable elevated temperature may be employed, preferred temperatures are in the range at least about 30° C. to about 200° C. However, it needs not be the same temperature as the dispersion temperature. The shearing action induces break-up of the dispersed resin droplets into smaller droplets and the surfactant molecules coat the surfaces of the smaller droplets thereby preventing the droplets to coalesce back into larger droplets. The break-up of droplets into smaller droplets continue until the droplet size reaches an equilibrium value determined by the amount of surfactant relative to that of total resin in the vessel. The shearing required for the comminuting step of the present inventive process is substantially smaller due to the presence of the vaporizable plasticizer component compared to that for the process without a vaporizable plasticizer component. For example, effective comminution may be accomplished in a vessel containing a 10 cm radius impeller-type agitator and with the agitator rotation speed as low as 100 rpm. This comminution operation typically lasts for between about 30 minutes and 10 hours.

The step of removing the vaporizable plasticizer component from the comminuted first resin composition is typically carried out by maintaining the mixture of the first resin components and the organic medium at an elevated temperature above the boiling temperature of the vaporizable plasticizer component. Under the condition, the vaporizable plasticizer component evaporates from the comminuted particulate resin composition and subsequently from the processing vessel. The process may be more expeditiously carried out when the vaporizable plasticizer composition is immiscible with the organic medium. The removal step is stopped when the vaporous effluent from the process vessel does not show a trace of the vaporizable plasticizer component.

The steps of dispersion, comminution and removal of the vaporizable plasticizer component may be conducted in distinctive and discontinuous steps, sequentially in a single vessel, sequentially in multiple vessels or in a series of overlapping steps in a single vessel.

The step of recovering the comminuted toner particles is carried out by first cooling the content of the process vessel below the glass transition temperature of the resin component and subsequently by filtering solid resin particles from the organic medium. Any suitable filtration equipment may be used. Subsequently, dry resin particles are obtained by washing the filtered particles with a low boiling organic solvent such as isohexane and drying off the wash solvent at a temperature below the glass transition temperature of the resin component.

In another aspect of the present invention, there is provided a particulate resin composition comprising resin particles that are substantially spherical in shape, have an average diameter of from about 1 to about 10 microns, and have a uniform and narrow size distribution with the span value less than 1.0. Preferably, the span value is less than 0.8 and the particles are prepared by comminuting a precursor resin composition comprising a vaporizable plasticizer component in an organic medium under shear at an elevated temperature wherein the particles are substantially insoluble in the organic medium. The resin may be a polyester resin or a styrene copolymer resin.

In yet another aspect of the present invention, there is provided a particulate resin composition comprising resin particles that are substantially spherical in shape, have an average diameter of from about 1 to about 10 microns, have a uniform and narrow size distribution with the span value less than 1.0, more preferably, with the span value less than 0.8. The particles have an irregular surface texture characterized by the surface roughness index greater than 1.2, the surface roughness index being defined as the ratio of surface areas of the irregular textured particles and smooth texture particles. The resin may be a polyester resin or a styrene copolymer resin.

In general, it may be possible to achieve surface roughness indices of greater than 1.2 or so and up to as high as 5 or more and span values of the particle size distribution of less than 0.8 down to 0.5 or even 0.2.

In still yet another aspect of the present invention, there is provided a particulate resin composition comprising a polyester resin component and an optional charge control agent wherein the particles are substantially spherical in shape, have a volume average diameter in the range of from about 1 to about 10 microns, have a uniform and narrow size distribution with the span value less than 1.0, more preferably, with the span value less than 0.8. The particles have an irregular surface texture characterized by the surface roughness index greater than 1.2 wherein the polyester resin component includes a polyester resin having a weight average molecular weight of about 100,000 g/mol or less.

In a still further aspect of the present invention, there is provided a particulate resin composition comprising a styrene copolymer resin component and an optional charge control agent wherein the particles are substantially spherical in shape, have a volume average diameter in the range of from about 1 to about 10 microns, have a uniform and narrow size distribution with the span value less than 1.0, more preferably, with the span value less than 0.8. Here again, the particles have an irregular surface texture characterized by the surface roughness index greater than 1.2 wherein the styrene copolymer resin component includes a styrene copolymer having a weight average molecular weight of about 100,000 g/mol or less. Particularly preferred styrene copolymer resins include copolymers of styrene and acrylate as well as copolymers of styrene and butadiene.

In the present invention, it is preferable to produce small resin particles which have a volume average particle size in the range –10 $\mu$m. The terms "volume average particle size" is defined in, for example, *Powder Technology Handbook*, 2nd edition, by K. Gotoh et al, Marcell Dekker Publications (1997), pages 3–13. More specifically, it is preferable to produce resin particles which include particles with the span value less than 1.0. This is because, when the resin particles are made into a particulate toner composition while maintaining the particle size distribution, the toner particles with such a narrow particle size distribution provide toner particles which have uniform quantity of electric charge in each toner particle, and can provide high-quality copy images and for which charge control is easy in a development unit.

In accordance with the present invention, the particle size distribution is determined using a commercially available Coulter LS Particle Size Analyzer (made by Coulter Electronics Co., Ltd., St. Petersburg, Fla.). The data are often represented by the cumulative volumetric diameter distribution diagram in which the volume fraction (or the percent by volume) of the particles with the diameter less than a value is plotted against the diameter value. It was stated earlier that the span is a measure of the narrowness of the diameter distribution and is defined as the ratio of the diameter range in which the middle 80 percent by volume of-the particles occupy to the median diameter. More specifically, the span is defined by the formula:

$$\text{Span}=(d_{90}-d_{10})/d_{50}$$

Here, $d_{10}$ is the diameter value at which the volume fraction is 10 percent by volume in the cumulative volumetric diameter distribution diagram, $d_{90}$ the diameter value at which the volume fraction is 90 percent and $d_{50}$ the diameter value at which the volume fraction is 50 percent. Therefore, a smaller span value means a narrow distribution of the particle diameter.

The surface area of particulate resin composition is determined from the BET adsorption isotherm measurement. The BET isotherm is measured using a commercially available Automatic Volumetric Sorption Analyzer (Model No. ASAP2000, Micromeritics Instrument Corporation, Norcross, Ga.). In the measurement, the amount of adsorptive ($N_2$ in our case) adsorbed on the particle surface at a reduced pressure is determined. The surface area is estimated from a plot of the adsorptive amount relative to the pressure. A detailed description of the experimental method and the theoretical basis of the BET adsorption isotherm may be found in pp.615–631, "Physical Chemistry of Surfaces," $6^{th}$ edition, by A. W. Adamson and A. P. Cast (1997), John Wiley and Sons, NY, N.Y.

The surface roughness index used in the present invention is defined as the ratio of surface area ($A_{exp}$) of 1 gram of the particulate resin composition as determined by the BET isotherm method to the surface area of 1 gram of hypothetical spherical resin particles which have a perfectly smooth surface and also have a uniform distribution of diameter that is equal to the volume average diameter ($d_v$) of the actual particulate resin. The surface roughness index may then be represented by the formula:

$$\text{Surface roughness index}=(1/6)\rho d_v A_{exp},$$

Where $\rho$ is the density of the polymer resin. The index is a measure of how increased the surface area is due to surface roughness.

The features of the present invention will become apparent in the course of the following description of examples, which are given for illustration of the invention and are not intended to be limiting thereof.

EXAMPLES

Example 1

Preparation of a Cationically Dyeable Polyester Resin by Melt Condensation

A cationically dyeable polyester resin was prepared by a melt condensation process. Into a 10-liter glass reaction vessel fitted with a paddle-type stirrer and a 20 cm fractionating column, dimethyl terephthalate (941 grams, 4.85 moles), dimethyl isophthalate (970 grams, 5.0 moles), sodium salt of dimethyl 5-sulfoisophthalate (44.4 grams, 0.15 moles), and 1,2 propylene glycol (1520 grams, 20 moles) were charged. Further, 1.4 grams of titanium tetraisopropoxide and 5.0 grams of IRGANOX 1010 (available from Clariant Corporation, East Hanover, N.J.) were added as the ester exchange catalyst. The reactants were charged at ambient temperature and purged with argon gas for about 1 hour. The reactant mixture was then heated to 150° C. with the stirrer on at 50 rpm to form a homogeneous melt. Subsequently, the reaction mixture is heated from 150° C. to 200° C. under a flowing argon atmosphere over 4 hours and maintained at 200° C. until approximately 340 ml of distillate was collected.

The reaction mixture was then slowly heated to 210° C. in about 30 minutes and was maintained at the temperature for one hour while under agitation of 50 rpm. The agitator speed was then lowered to 30 rpm and the reactor was put under a vacuum of 0.5 torr for one hour. Subsequently, the vacuum was released with argon and the reactant cooled downed to about 150° C. The content of the reactor was poured onto glass plates and allowed to cool down to ambient temperature. Approximately 2050 grams of polyester resin was obtained.

The glass transition temperature of thus prepared polyester resin was 65° C. The number average molecular weight was 5500 and the weight average molecular weight of the polyester 11200 with the polydispersity of 2.1. The molecular weight is determined by the gel permeation chromatography (GPC) using polystyrene as molecular weight standard.

Example 2

Dispersion Comminution of Polyester Resin

Into a 1—1 round bottom flask equipped with a stirrer and a condensing column, 300 grams of the polyester resin of Example 1 and 90 grams of N,N-dimethylformamide were charged. The content was heated to 150° C. and maintained at the temperature for 20 minutes under a total reflux condition. When the mixture attained fluidity, 30 grams of Bontron E-84 (a charge control agent available from Orient Chemical Company, Springfield, N.J.) was added and the stirrer was set at 30 rpm. Then, the stirrer speed was raised to 100 rpm and maintained at the speed for one hour to thoroughly mix the resin and the additives.

Subsequently, 300 grams of 1:1 mixture of Isopar-L® and Isopar-V® (paraffinic solvents available from Exxon Chemical Company, Houston, Tex.) and 30 grams of Ganex V-220 (a non-ionic surfactant available form ISP Corporation, Wayne, N.J.) were charged into the flask. The content turned into a milky dispersion. The dispersion was maintained at the temperature and the stirring speed for 7 hours with the column set at a partial reflux condition. A particulate resin sample was collected and the particle size was determined. The resin particles had the volume average diameter of 4.5 micron and the span of 0.9. The content was allowed to cool down to ambient temperature. Then, 200 grams of iso-hexane was charged into the flask and the content was stirred for 1 hour. Resin particles were separated from the liquid by filtration. The resin particles were re-dispersed in iso-hexane and filtered twice. The resin particles was then vacuum-dried at 40° C. for 10 hours to obtain dry polyester particles.

The volume average diameter of the resin particles was 4.7 microns and the span was slightly reduced to about 0.85. Scanning electron microscopy examination of the resin particles showed that the particles were substantially spherical with a rough surface texture. The surface roughness index was determined to be about 2.1 from the BET isotherm measurement.

Example 3

Dispersion Comminution of Polyester Resin with Mixed Surfactants

A particulate polyester composition was prepared using the same procedure of Example 2 except that a mixture of 24 grams of Ganex V-220 and 6 grams of Genapol 26-L-1 (a non-ionic surfactant available from Clariant Corporation, Charlotte, N.C.) in place of 30 grams of Ganex V-220.

The volume average particle size was 4.7 microns and the span 0.85. Scanning electron microscopy examination of the resin particles showed that the particles were substantially spherical with rough surface texture. The surface roughness index determined by the BET isotherm measurement was 2.0. The example showed that the particle size is correlated to the amount of surfactant used in the dispersion comminution process.

Example 4

A Particulate Polyester Composition with a Small Average Diameter using a Larger Amount of Surfactant A particulate polyester composition was prepared using the same procedure of Example 2 except that 60 grams Ganex V-220 in place of 30 grams of the surfactant. The volume average particle size was 3.5 microns and the span 0.6. Scanning electron microscopy examination of the polyester particles showed that the particles were substantially spherical with rough surface texture. The surface roughness index determined by the BET isotherm was 1.9.

Example 5

A Particulate Polyester Composition with a Large Average Diameter using a Small Amount of Surfactant A particulate polyester composition was prepared using the same procedure of Example 2 except that 15 grams Ganex V-220 in place of 30 grams of the surfactant. The volume average particle size was 7.3 microns and the span 0.9. Scanning electron microscopy examination of the polyester particles showed that the particles were substantially spherical with rough surface texture. The surface roughness index determined by the BET isotherm was 2.1.

Example 6

Low Temperature Comminution using Acetone as the Vaporizable Plasticizer

Into a 1—1 round bottom flask equipped with a stirrer and a condensing column, 300 grams of the polyester resin of Example 1 and 180 grams of acetone were charged. The content was heated to 50° C. and maintained at the temperature for 20 minutes under a total reflux condition. When the mixture attained fluidity, the stirrer was set at 50 rpm was kept at the speed for one hour to thoroughly mix the resin and the additives.

Subsequently, 300 grams of 1:1 mixture of Isopar-L® and Isopar-V® and 30 grams of Ganex V-220 were charged into the flask under the shearing condition. The content turned into a milky dispersion. The temperature and the stirring speed were raised to 65 ° C. and 300 rpm, respectively. The dispersion was maintained at the temperature and the stirring speed for 4 hours with the column set at a partial reflux condition to remove acetone from the comminuted polyester particles. The content was allowed to cool down to ambient temperature. Then, 200 grams of iso-hexane was charged into the flask and the content was stirred for 1 hour. Resin particles were separated from the liquid by filtration. The resin particles were re-dispersed in iso-hexane and filtered twice. The resin particles were then vacuum-dried at 40° C. for 16 hours to obtain dry polyester particles.

The volume average diameter of the resin particles was 4.7 microns and the span 0.6. Scanning electron microscopy examination of the resin particles showed that the particles were substantially spherical with a rough surface texture. The surface roughness index was determined to be about 2.0 from the BET isotherm measurement.

Example 7

(Counter Example) Comminution without a Vaporizable Plasticizer

A particulate polyester composition was prepared using the same procedure of Example 2 but without N,N-dimethylformamide, the vaporizable plasticizer. The volume average particle size was 5.3 microns and the span 2.1. Scanning electron microscopy examination of the polyester particles showed that the particles were substantially spherical with smooth surface texture. The surface roughness index determined by the BET isotherm was 1.1.

Example 8

Preparation of an Acid-functionalized Styrene/acrylate Copolymer Resin

Into a 2–1 round bottom flask equipped with a stirrer and a condensing column, 738 grams of styrene, 180 grams of n-butyl acrylate, 39 grams of acrylic acid and 45 grams of 2,2'-azobisisobutylonitrile were charged at ambient temperature. The mixture was bubbled with argon for 30 minutes. Then temperature of the mixture was raised to 69° C. under stirring at 50 rpm. Polymerization ensued while the mixture was refluxed for 16 hours under argon atmosphere.

After the dispersion was cooled to ambient temperature, polymer particles were separated. The polymer particles were washed with a mixture of 80% by weight methanol and 20% by weight water three times and vacuum dried at 50° C. for 16 hours. About 700 grams of polymer resin was obtained.

The resulting polymer has the number average molecular weight of 16,000 and weight average molecular weight of 53,000. The glass transition temperature was 62° C.

Example 9

Comminution of the Acid-functionalized Styrene/acrylate Copolymer Resin

Into a 1—1 round-bottom flask equipped with an impeller-type agitator and a condenser, 150 grams of the acid-functionalized styrene-acrylate copolymer resin of Example 8 and 90 grams of tetrahydofuran as the vaporizable plasticizer component were charged at ambient temperature. The content was agitated to form a mixture and then heated to 50° C. under a total reflux condition. The resin mixture was maintained at the temperature under an agitation of 50 rpm impeller rotation for 60 minutes after which it had attained a sufficient fluidity.

Subsequently, 150 grams of poly-(ethylene oxide) as the immiscible solvent component and 7.5 grams of sodium dodecylsulfate as the surfactant were charged into the flask which contained the resin composition and was maintained under agitation at 50° C. After completing the charging, the mixture was further maintained at the temperature under an increased shearing of 100 rpm impeller rotation. The mixture turns opalescent in appearance after about 10 minutes at which point the condenser was adjusted to a partial reflux condition. After 2 hours of shearing at 50° C., the temperature of the content of the flask was raised to 80° C. to expedite the evaporation of tetrahydrofuran. The content was maintained at the shearing condition until the vapor effluent stopped showing a trace of tetrahydrofuran and the dispersion was allowed to cool down to the ambient temperature. The comminuted resin particles were separated from the solvent using a filtration process. The solvent medium entrained in the filter cake was washed off by re-dispersing the filter cake in water and re-filtering three times. The re-filtered particles were vacuum-dried at 60° C. for 10 hours to obtain dry resin particles.

The resulting particulate styrene-acrylate composition had the volume average particle diameter of 6.8 microns and the span of 0.7. Scanning electron microscopy examination of the resin particles showed that the particles were substantially spherical with a coarse surface texture. The surface roughness texture of the resin particles as determined by the BET isotherm methods was 2.2.

Figure 2:
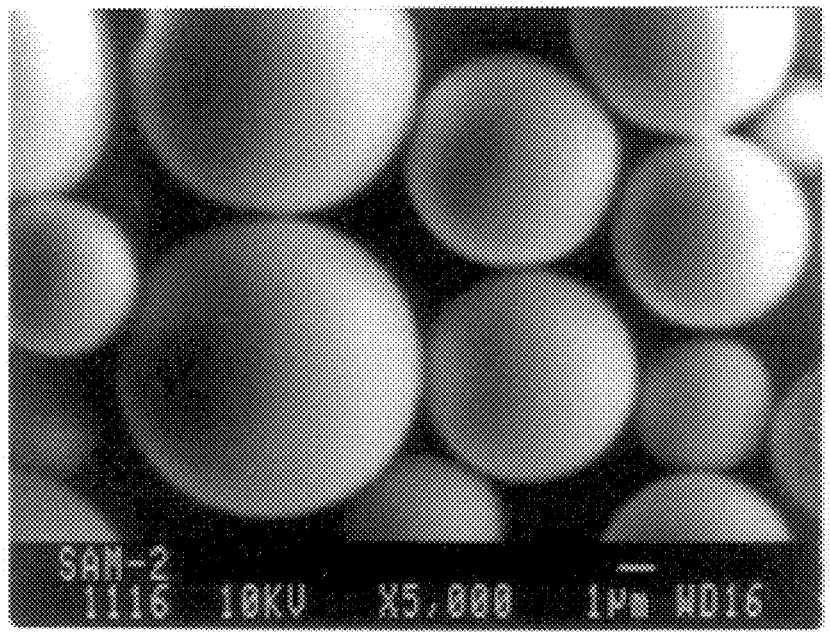
FIG. 2 is a scanning electron micrograph of a toner composition of which particles have smooth surface texture.
Figure 3:
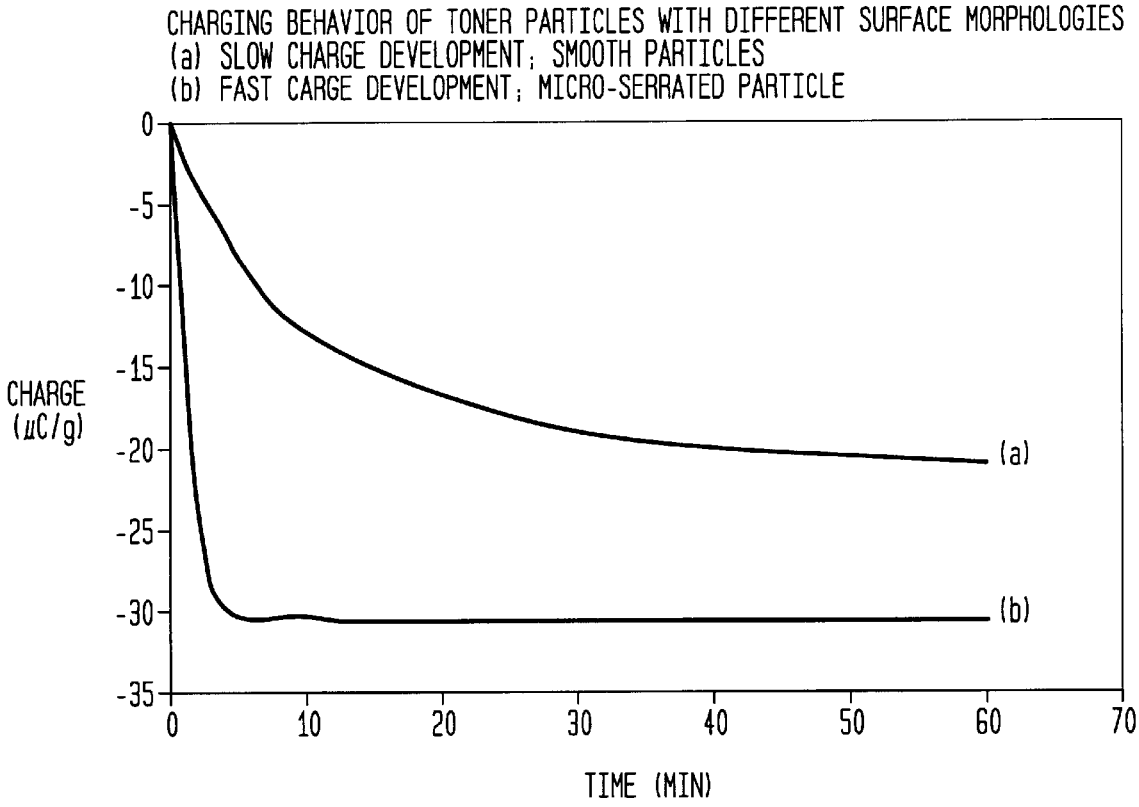
FIG. 3 is a plot of triboelectric charge development as a function of toner-carrier mixing time. The data demonstrates that the micro-serrated surface texture is conducive for rapid charge development.

The invention is perhaps better appreciated by viewing FIGS. 1–3. FIG. 1 is a photomicrograph (5000X) showing toner particles with the micro-serrated surface generally of the type achieved in accordance with the present invention. FIG. 2, on the other hand is a photomicrograph of particles having smooth surfaces. The micro-serrated particles of the present invention typically develop charge more quickly than conventional smooth particles as can be seen in FIG. 3. FIG. 3 is a plot of triboelectric charge development as a function of toner-carrier mixing time. It will be appreciated from FIG. 3 that micro-serrated particles develop a charge of 30 micro coulombs per gram in a fraction of the time required to impart a similar charge to smooth particles.

While the invention has been illustrated and described in connection with numerous embodiments, modification to such embodiments within the spirit and scope of the present invention will be readily apparent to those of skill in the art. The invention is defined in the appended claims.

What is claimed is:

1. A particulate composition consisting essentially of resin particles formed of a polyester resin and optionally containing a charge control agent, said resin particles being suitable for making color toner and characterized in that said particles are prepared with a vaporizable plasticizer which is absorbable in the polyester resin and has a boiling point of less than 200° C., and wherein the particles containing plasticizer are dispersed in an organic medium in which they are insoluble and the plasticizer is removed from the particles while they are dispersed in the organic medium by maintaining the dispersion at an elevated temperature close to or above the boiling temperature of the vaporizable plasticizer such that the particles are provided with a micro-serrated surface wherein the particles exhibit a surface roughness index of greater than about 1.2, the surface roughness index being determined by the formula:

$$\text{surface roughness index}=(1/6)\rho d_v A_{exp}$$

where ρ is the density of the polyester resin, $d_v$ is the volume average diameter of the resin particles and $A_{exp}$ is the surface area of 1 gram of the particulate resin composition as determined by nitrogen absorption using the BET isotherm method.

2. The particulate composition according to claim 1, wherein said resin particles have a micro-serrated surface exhibiting a roughness index of greater than about 1.5.

3. The particulate composition according to claim 2, wherein said resin particles have a micro-serrated surface exhibiting a roughness index of greater than about 2.

4. The particulate composition according to claim 1, wherein the particles of said composition are substantially spherical in shape and have a volume average diameter in the range of from about 1 to about 10 microns, with a span value less than about 1.0.

5. The particulate composition according to claim 4, wherein said resin particles have a volume average particle size of from about 3 to about 8 microns.

6. The particulate composition according to claim 4, wherein the span value is less than 0.8.

7. The particulate resin composition according to claim 1, wherein said composition includes a charge control agent selected from the group consisting of positive charge control agents and negative charge control agents.

8. The particulate resin composition according to claim 7 containing a charge control agent selected from the group consisting of: quaternary ammonium compounds; organic sulfate and sulfonate compositions; bisulfonates; ammonium sulfates (DDAES); distearyl dimethyl ammonium bisulfate (DDAMS); cetyl pyridinium tetrafluoroborates; distearyl dimethyl ammonium methyl suflate; aluminum salts; quaternary ammonium nitrobenzene sulfonates; and mixtures thereof.

9. The particulate resin composition according to claim 8, wherein said quaternary ammonium compounds are selected from the group consisting of alkyl pyridinium halides and alkyl pyridinium.

10. The particulate composition according to claim 1, wherein said resin particles are provided with functional sites suitable for interacting with functionalized dyes.

11. The particulate composition according to claim 9, wherein said functional sites of said resin particles suitable for interacting with a functionalized dye are selected from the group consisting of: hydroxy moieties; alkoxy moieties; sulfonic or derivatized sulfonic moieties; sulfinic or derivatized sulfinic moieties; carboxyl or derivatized carboxyl moieties; phosphonic or derivatized phosphonic moieties; phosphinic or derivatized phosphinic moieties; thiol moieties; amine moieties; alkaline moieties; quaternized amine moieties; and mixtures thereof.

12. The particulate composition according to claim 10, wherein said polyester resin is an amorphous resin with a glass transition temperature in the range of from about 40 to about 90° C. and the weight average molecular weight in the range of from about 3,000 g/mol to about 100,000 g/mol.

13. The particulate composition according to claim 1, wherein the particles are substantially spherical in shape and have a volume average diameter in the range of from about 1 to about 10 microns with the span value less than 1.0 wherein said polyester resin has a weight average molecular weight of about 100,000 g/mol or less.

14. The particulate resin composition according to claim 13, wherein said polyester resin particles have a micro-serrated surface texture characterized by the surface roughness index greater than 1.5.

15. A particulate resin composition suitable for production of particulate toner composition of resin particles consisting essentially of a polyester resin optionally containing a charge control agent, wherein said particles are substantially spherical in shape, have an average diameter of from about 1 to 10 microns, with the span value less than 1.0 and are prepared by way of comminuting a precursor polyester resin composition comprising a vaporizable plasticizer in an organic medium under shear at elevated temperature wherein said particles are substantially insoluble in said organic medium and wherein the vaporizable plasticizer has a boiling point of less than 200° C. and is removed from the particles while they are dispersed in the organic medium by maintaining the dispersion at an elevated temperature close to or above the boiling temperature of the vaporizable plasticizer such that the particles are provided with a micro-serrated surface wherein the particles exhibit a surface roughness index greater than about 1.2, the surface roughness index being determined by the formula:

$$\text{surface roughness index}=(1/6)\rho d_v A_{exp}$$

where $\rho$ is the density of the polyester resin, $d_v$ is the volume average diameter of the resin particles and $A_{exp}$ is the surface area of 1 gram of the particulate resin composition as determined by nitrogen absorption using the BET isotherm method.

16. The particulate resin composition according to claim 15, wherein said resin particles are formed of a polyester having a glass transition temperature of from about 40° C. to about 90° C. and a molecular weight in the range of from about 3,000 g/mol to about 100,000 g/mol.

* * * * *